United States Patent [19]

Hergert

[11] 3,997,947

[45] Dec. 21, 1976

[54] METHOD AND APPARATUS FOR PILE FABRIC FINISHING WITH A PLURALITY OF ELECTRIFIER CYLINDERS

[75] Inventor: Heinz Hergert, Frankfurt am Main, Germany

[73] Assignee: Polrotor Inc., N. Amityville, N.Y.

[22] Filed: Apr. 16, 1975

[21] Appl. No.: 568,592

Related U.S. Application Data

[63] Continuation-in-part of Ser. No. 384,092, July 30, 1973, abandoned.

[52] U.S. Cl. ..... 26/2 E; 26/69 R

[51] Int. Cl.[2] ..... D06C 29/00; D06C 23/02

[58] Field of Search ..... 26/2 E, 27, 69 R, 69 B

[56] References Cited

UNITED STATES PATENTS

| | | | |
|---|---|---|---|
| 1,913,114 | 6/1933 | Green | 26/2 E |
| 2,170,968 | 8/1939 | Gentle | 26/2 E UX |
| 2,961,733 | 11/1960 | Hart | 26/2 E |
| 3,822,447 | 7/1974 | Frishman | 26/2 E |

FOREIGN PATENTS OR APPLICATIONS

| | | | |
|---|---|---|---|
| 1,635,274 | 1/1967 | Germany | 26/2 E |
| 494,149 | 5/1954 | Italy | 26/69 B |
| 5,392 | 1896 | United Kingdom | 26/69 R |

OTHER PUBLICATIONS

Polrotor, Bulletins of Polrotor, Inc. Heinz Hergert, Farmingdale, N.Y., 4 pages each.

*Primary Examiner*—Robert R. Mackey
*Attorney, Agent, or Firm*—Eisenman, Allsopp & Strack

[57] ABSTRACT

A plurality of electrifier cylinders are arranged in tandem along the conveyance path of a synthetic pile fabric. Each cylinder is provided with surface grooves in opposite directions in order to introduce a bias of different directions to the individual fibers being treated. Individual speed and temperature controls are provided for these cylinders to effect a wide range of treatments.

10 Claims, 10 Drawing Figures

| CYLINDER ROTATION | | DIRECTIONS OF GROOVE FORCE | |
|---|---|---|---|
| GROOVES 12 | GROOVES 13 | | |
| CW | CW | IV | III |
| CW | CCW | IV | I |
| CCW | CW | II | III |
| CCW | CCW | II | I |

METHOD AND APPARATUS FOR PILE FABRIC FINISHING WITH A PLURALITY OF ELECTRIFIER CYLINDERS

This is a continuation-in-part of co-pending application Ser. No. 384,092, filed July 30, 1973, now abandoned.

BACKGROUND OF THE INVENTION

1. Field of the Invention

This invention is concerned with the processing of pile fabrics. More particularly, it relates to a method and apparatus for the treatment of pile fabrics using a plurality of controlled electrifier cylinders in tandem.

2. Description of the Prior Art

Within the content of the present invention, the general classification "pile fabrics", covers a variety of materials. These materials range from fine velours to heavy carpeting, and include such diverse products as napped liners, suedes, flocked prints, velvets, and double-sided blankets. The basic cloth from which such pile fabrics are produced may be knitted, tufted, or woven.

Pile fabric processing, irrespective of the particular material involved, is primarily concerned with developing a final product having desired characteristics and appearance. Usually, when this objective is achieved, the individual fibers of the product have a particular length, amount of tangle, and lay. Permanence of the finish is important.

A well recognized treatment for finishing pile fabrics employs rotating electrifier cylinders. Such elements consist of large heated metallic cylinders having a pattern of grooves on the surface. The heat of the cylinder serves to soften synthetic fibers and an electrostatic charge is imparted which assists in straightening and untangling each fiber. The surface grooves treat the fabric in a number of ways including: beating, rubbing, twisting, and erection.

As explained more fully hereinafter, a wide variety of surface groove patterns have been used to achieve optimum or special pile finishing effects. A recent development in this area is disclosed in U.S. Pat. No. 3,557,415 granted to D. Kloeckener in Jan. 26, 1971, The electrifier cylinder in this patent has a first plurality of grooves disposed with a relatively shallow pitch across the width of the cylinder and a second plurality of steeply pitched grooves disposed in intersecting relationship with the first plurality. As described therein, this configuration of grooves makes it possible to simultaneously effect longitudinal and cross-sweeping of the pile.

Although it has been well recognized that the depth of penetration of pile treatment, the permanence of the finish, and the lay of the pile are determined by such factors as the temperature of the cylinder, the degree of fabric wrap about the cylinder, the groove configuration and speed of cylinder rotation, the prior art has not provided a versatile method or apparatus for varying these critical conditions within a worthwhile range. Prior to the present invention, an operator was confined to using a particular cylinder with its specific groove configuration. The temperature of the cylinder could be varied to establish the slope of the linear temperature gradient experienced by the fabric during treatment; but the shape of this gradient could not be controlled. The groove power and its effect upon beating, oscillation, erection, and ultimate lay could be enhanced or decreased by changing cylinder speed; but the general characteristics imposed by the particular groove configuration, e.g. a right or left-handed lay, could not be modified.

Techniques for optimizing the available range of operation from a single electrifier unit are disclosed in U.S. Pat. Nos. 3,413,695, 3,465,397 and 3,586,228, granted to the inventor in Dec. 3, 1968, Sept. 9, 1969 and June 22, 1971, respectively; in each instance it will be appreciated that the operator was restricted by the limited range of temperature and groove power available with the specific electrifier cylinder employed. Since these cylinders are both large and expensive, one cannot easily stock a variety for interchange depending upon the fabric or fabric treatment contemplated.

In the past, the treatment of pile fabrics has often included multiple passages of the fabric through electrifier units. The number of passes depended upon the original set of the fibers and the desired final finish. In order to obtain greater changes from the original set, the processor was limited by the inherent design limitations of the cylinder employed. In 1960, Hart U.S. Pat. No. 2,961,733 disclosed the use of two electrifier cylinders upon a single unit, in order to expedite the processing of a fabric in a single passage. Necessarily, Hart was restricted to the use of existing cylinder designs. Thus, the Hart apparatus was able to produce in one passage the cumulative effect of two passages using single cylinder units.

SUMMARY OF THE INVENTION

The present invention provides a method and apparatus for the versatile finishing of pile fabrics. With the method and apparatus of this invention, the equipment operator may determine and change at will, the lay of the fabric, and the degree of penetration of treatment. He may also establish optimum temperature conditions for a wide variety of fabrics and finishes.

An object of the invention is to provide an improved method involving electrifier treatment of synthetic pile fabrics.

Another object of the invention is to provide improved electrifier apparatus for the treatment and finishing of synthetic pile fabrics.

Another object of the invention is to provide an improved method and apparatus for synthetic pile treatment affording a wide and conveniently varied range of processing conditions.

Another object of the invention is to provide an improved method and apparatus for synthetic pile treatment affording superior temperature control during electrifier processing.

In accordance with one aspect of the invention, there is provided a method for treating synthetic pile fabric comprising transporting the fabric along a predetermined path, subjecting the fibers of the fabric for a controlled period of time to beating, electrification and heating as it passes a first location along the path, and thereafter subjecting the fibers for a second controlled period of time to beating, electrification, and heating as the fabric passes a second immediately adjacent location along the path. At the first location, the lay of the fabric is biased in the direction of a single quadrant only. At the second location, the lay of the fabric is biased in the direction of a second quadrant only; wherein the second quadrant is adjacent to the first and is in the opposite lateral direction. In effect, this results in the successive biasing of the fiber surface in opposing lateral directions, or a cross sweeping of the surface at each distinct location. By controlling the particular quadrants in two stages, one is able to assure controlled erection of the pile in accordance with the desires of an operator, in a single passage of the fabric through the dual cylinder unit.

In accordance with another aspect of the invention, apparatus is provided which comprises a pair of adjacent electrifier cylinders mounted for rotation about parallel axes, said first cylinder having longitudinal grooves in the surface thereof inclined in a first direction only and said second cylinder having longitudinal grooves in the surface thereof inclined in the opposite direction only, means for transporting a pile fabric along a path substantially-orthogonal to these axes and in proximity to the cylinders, means for rotating the cylinders at various rates of speed, and means for independently controlling the temperatures of the cylinders.

A complete appreciation of the objects and features of the present invention, along with an understanding of the unique aspects thereof, will be available from the following description and the appended drawings.

DESCRIPTION OF THE PREFERRED EMBODIMENT

Figure 1:
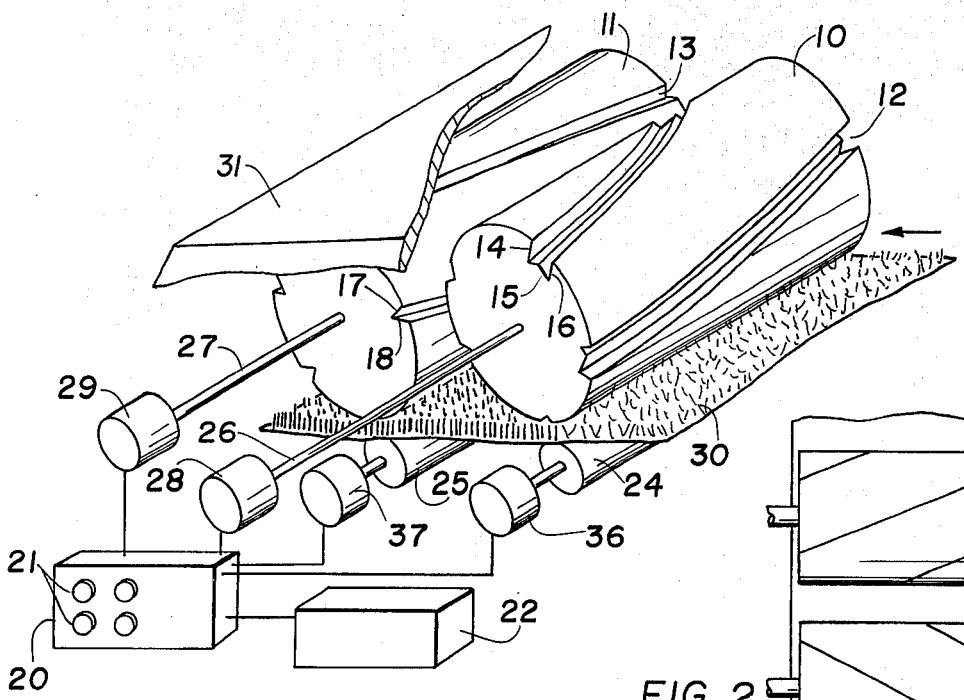
FIG. 1 is a perspective illustration showing the principal components employed in an embodiment of the present invention.

FIG. 1 shows a pair of electrifier cylinders 10, 11, arranged in tandem along the path of a pile fabric 30. The grooves 12 on cylinder 10 may be said to have a left-hand pitch, if one defines the direction of pitch by analogy with machine screw terminology, and compares the grooves with threads. The grooves 13 of cylinder 11 have a right-hand pitch. It will also be noted that grooves 12 may be of the type considered "double acting". The front profile of these grooves illustrates that each shoulder 14, 16 is substantially perpendicular to the surface of the cylinder. Between the shoulders, at 15, there are relatively gently converging slopes toward the surface. This groove design is particularly useful where it is contemplated to rotate the cylinder in either direction. In contrast, grooves 13 are of the more conventional type having a downstream shoulder 17 substantially perpendicular to the surface of the cylinder, and a sloping upstream return wall 18. In an actual installation, the particular groove style, pitch, and configuration, are dependent upon the type of fabrics and treatment contemplated. The present invention provides a wide range of operations irrespective of the particular grooves selected.

Each cylinder 10, 11, is mounted upon a shaft 26, 27 which may be rotated by a variable speed motor 28, 29, respectively. In the illustrated embodiment motors 28, 29 are controlled by electronic circuitry within a control console 20, respective to the position of rheostats which may be manually set by controls 21. Control circuitry of this type will aford a range of speeds and will also yield reversing capability if desired. The variable speed drive units and Reeves Motodrives are specific examples of automatically and remotely controlled units suitable for use in controlling the drive and speed of the cylinder shafts.

Cylinders 10 and 11 may employ conventional heating elements and the electrical leads for such elements are supplied with power from power supply 22. The well known "calrods" manufactured by the General Electric Company, may be employed to heat the electrifier cylinders. In this case, standard temperature sensing and thermostat controllers are used to achieve the desired temperature controls. Here too, the amount of power applied and hence the temperatures, may be controlled by rheostat devices which are in turn governed by manually setable dials 21, within the control console 20.

FIG. 1 shows fabric 30 approaching the electrifier cylinder 10, 11 from the right. The specific conveyance means has not been illustrated and may take any of the many conventional forms. In proximity to each cylinder, a cloth rest 24, 25 is illustrated for presentation of the fabric to the respective cylinders. One is not limited to the use of a simple cylindrical cloth rest. The contoured cloth rests disclosed in the inventor's U.S. Pat. No. 3,785,016, may be employed with particular advantage in conjunction with the present invention. On the other hand, apron cloths rests or fabric conveyors of the type disclosed in the above cited U.S. Pat. No. 3,586,228, may be used. In the particular embodiment of FIG. 1, separate variable speed motors 36, 37 control rotation of cloth rests 24, 25 and these motors are in turn electrically controlled from the control console 20.

It is contemplated that one may use controls which interrelate the rotating speeds of the cylinders and/or of the cloth rests, where desired. It is of course possible to use fewer prime movers and couple these prime movers to the various elements mechanically. This is clearly within the skill of those familiar with this art.

FIG. 1 does not illustrate each element of either the fabric conveyance system or the electrifier apparatus. For example, the typically present vacuum hood used to surround electrifiers is depicted only by fragmentary hood portion 31. Only those elements which are believed necessary to fully appreciate the invention, have been illustrated.

Figure 3A:
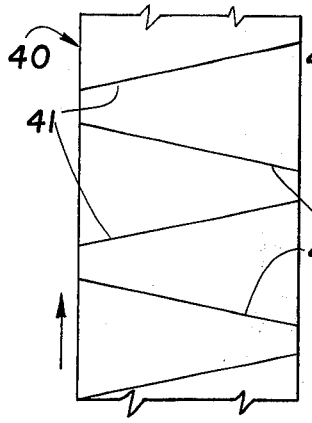
FIG. 3A PRIOR ART
FIGS. 3A, 3B and 3C illustrate typical groove layouts on electrifier cylinders of the prior art.
Figure 3B:
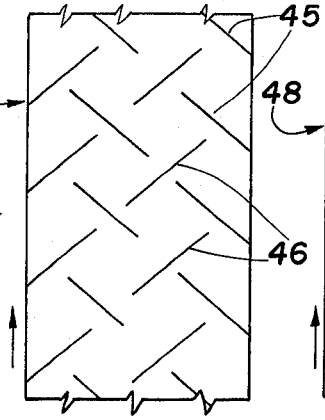
FIG. 3B PRIOR ART
Figure 3C:
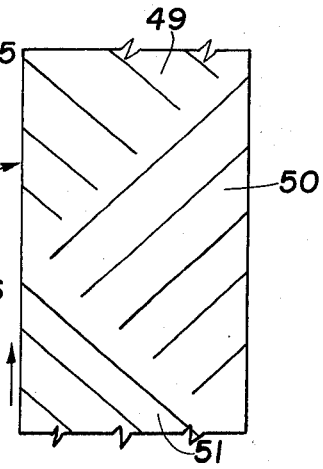
FIG. 3C PRIOR ART

An appreciation of the improved pile treatment effected with the method and apparatus of this invention, is enhanced by consideration of the typical prior art electrifier cylinder groove layouts shown in FIGS. 3A, 3B, and 3C.

FIG. 3A is a developed view of a portion of the surface of a prior art electrifier cylinder 40 having alternately disposed grooves 41, 42 of opposing pitch. The effect of these grooves is to alternately sweep the pile, assuming cylinder rotation in the upward direction as shown, first to the left and then to the right. This causes a lusterizing on the front right and front left portions of the fibers, respectively. With such a cylinder it is anticipated that the final lay of the fabric will be substantially uniform. It is noted, however, that neither the side nor the rear portions of the fibers have been treated.

FIG. 3B illustrates a developed view of a portion of the surface of another type of prior art electrifier cylinder 44 wherein different pitch angles are achieved by using short incomplete grooves 45, 46. With this type of groove pattern one sacrifices groove power and may effect streaking in the fabric because there is non-uniform treatment across the entire surface area of the fabric.

FIG. 3C illustrates a developed view of a portion of the surface of still another electrifier cylinder 48 wherein separate fields of grooves 49, 50, 51 are presented. In this instance, one may achieve relatively steep groove angles with the consequent more complete treatment of the fiber surfaces; however, there is not a consistent treatment of the pile across the entire fabric surface.

Figure 2:
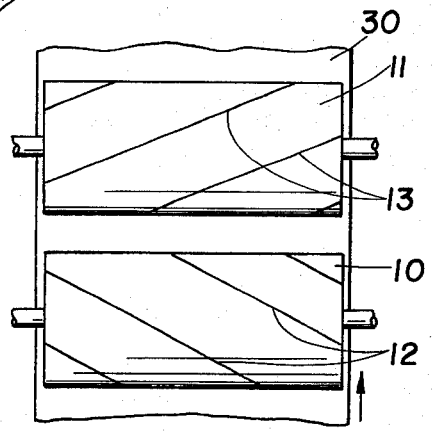
FIG. 2 is a top view showing a pair of typical electrifier cylinders arranged in accordance with the features of the present invention.

In contrast with using single cylinders, applicant's invention resides in the use of a pair of electrifier cylinders in tandem. FIG. 2 is a top schematic view of such a pair of cylinders. Assuming that each cylinder 10, 11 rotates clockwise as viewed from the left, grooves 12 will effect a sweeping of the pile to the left as the fabric approaches from the bottom of the FIGURE. Thereafter, grooves 13 will effect a sweeping to the right. The cylinders 10, 11 are arranged in close proximity to one another so that the fabric does not lose either its heat or electrostatic condition while traversing the area between the cylinders. With this arrangement, one is able to achieve completely uniform treatment across the entire surface of the fabric. One is also able to utilize each cylinder with maximum efficiency without running the risk of excessively distorting the fabric fibers either to the left or to the right. The lay of the finished fabric can be strictly controlled and, if desired, can be selectively biased to produce special visual effects.

Figures 6, 7:
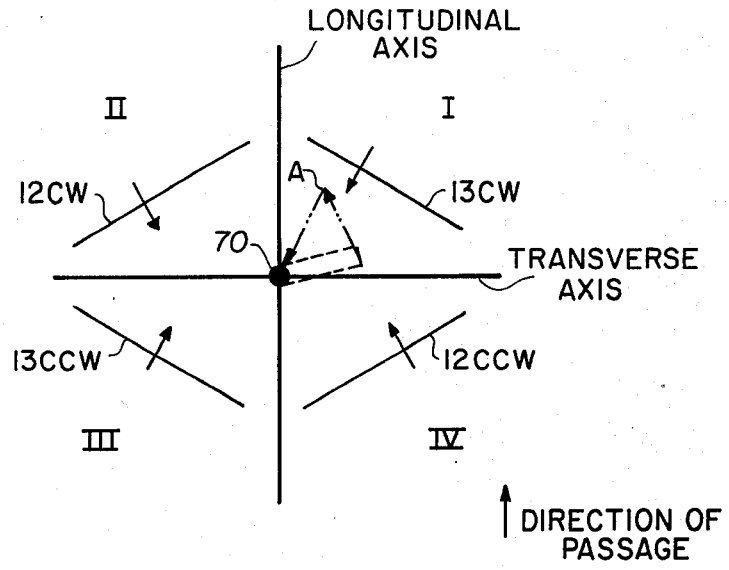
FIG. 6 is a schematic view of a single fiber viewed from above, with the surrounding area defined by axes in order to understand the forces applied to this fiber in accordance with the teachings of the invention.
FIG. 7 is a table showing the direction of force applied to the illustrative fiber of FIG. 6 when the cylinders of the invention are rotated in various directions.

FIG. 6 is a pictorial schematic of a single fiber, as viewed from above. It should be assumed that this fiber is part of a fabric being processed by the invention. The fabric is moving along the longitudinal axis in an upward direction, as viewed in the FIGURE. The transverse axis of the FIGURE is orthogonal to the longitudinal axis and of course runs perpendicular to the direction of movement. It will be seen that these two axes define the conventional four quadrants I, II, III, and IV.

Each quadrant contains a line which is pierced by an orthogonally disposed arrow directed in the direction of the fiber 70. These lines are representative of the groove pitch on cylinders 10 and 11 of FIG. 2. Their position and the arrows associated therewith, represents the direction of biasing effect these grooves have upon fiber 70, depending upon the direction of rotation of the respective cylinders. Each line bears an alphanumeric notation denoting the particular grooves involved, i.e. 12 or 13; and the direction of cylinder rotation, i.e. cw (clockwise) or ccw (counter clockwise). Thus, the line 13 cw appearing in quadrant I indicates that the grooves 13 on cylinder 11, develop a force in the direction of the arrow when the cylinder rotates in a clockwise direction as viewed from the right of FIG. 2.

Because application's method and apparatus are restricted to the utilization of cylinders whose grooves are individually pitched in one direction only, the grooves operate toward one quadrant only. This is an important distinction because it results in biasing treatment of the fibers in only one lateral direction by each cylinder. In contrast, all prior known and used cylinders were specifically designed for cross sweeping of the fibers. These prior cylinders were also designed to minimize the overall biasing effect of this cylinder and effect a generally even treatment from a transverse or lateral aspect.

The ability to effect straightening of a fiber in accordance with applicant's method and with these oppositely biased cylinders of the invention, may be appreciated by considering the dotted outline of a fiber that is originally set in the first quadrant of FIG. 6. In order to render this fiber erect, it must be heated, charged, and forced toward the origin of the coordinant system. To accomplish this in accordance with the present invention, forces are applied in two successive quadrature directions. The particular forces and the direction of force application are determined by the original set of the fiber, the desire to final set, and the groove pitch on the cylinder.

In order to render the fiber 70 erect with the particular groove pitch shown in FIGS. 2 and 6, it is necessary to operate cylinder 10 counter clockwise and cylinder 11 clockwise. Counter clockwise rotation of cylinder 10 results in the application of groove power by grooves 12, in the direction of quadrant II. Similarly, clockwise direction of cylinder 11 results in the application of groove power by grooves 13 in the direction of quadrant III. If one considers the resultant positioning of the dashed fiber in response to this power, it will be seen that it first moves to position A and thereafter to the origin of the coordinant system. Obviously, the amount of groove power applied in any direction, varies depending upon the set of the fiber and the desired ultimate position. One is able to modify the groove power by adjusting the speed of the cylinder. This speed is of course relative to the speed with which the fabric is being transported, and the speed of the cooperating cylinder. Still further, the groove power may be adjusted relative to the temperature of the cylinders which in turn affects the flexibility and pliability of the fibers.

The table of FIG. 7 sets forth the direction of groove force resulting from various rotational directions of cylinders 10 and 11.

It is recognized that electrifier treatment is basically designed to straighten out the fabric fibers and establish a consistent pile finish. The degree of straightening may vary in accordance with the desires of the fabric designer. Thus, it may be desired to have each fiber perfectly straight and projecting orthogonally upward from the backing. Alternatively, it may be desired to straighten only the tips of each fiber leaving the portion near the backing in a crimped or tangled condition. It may also be desired to leave the fibers in either a fully straightened or partially straightened condition with a dominant lay in a first or second direction. The amount of straightening imparted by a particular cylinder is a direct function of the penetration of the treatment and this in turn depends upon the temperature of the fabric and the proximity of the fabric to the electrifier cylinder. For a given temperature and proximity, the effect of the cylinder grooves upon the individual fibers is determined by a number of features including the speed of cylinder rotation, the configuration of the grooves, and the groove pitch angles.

The tandem arrangement of two cylinders, each controlled relative to both temperature and speed, assures freedom to produce virtually any condition of finish and pile lay in one pass. It is important that the fibers are treated by the downstream cylinder 11 while still in the plastic state developed by the upstream cylinder 10. The cylinders must be sufficiently close together to avoid setting of the fibers therebetween. The equipment operator may monitor the emerging fabric and by simple adjustments, effect changes in the lay of the pile and the degree of penetration. This is contrasted with prior arrangements wherein the equipment operator was bound by the groove configuration upon an individual cylinder to accept the lay of the fabric and to correct undesired conditions by reprocessing.

Figure 5:
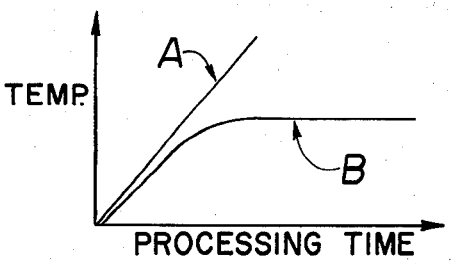
FIG. 5 is a graph showing fabric temperature curves developed by prior art systems as compared to the present invention.

The improved temperature control achieved with this double cylinder treatment method is graphically demonstrated by consieration of the temperature curves in FIG. 5. These curves plot temperature as ordinates, as a function of processing time as the abscissa. Two curves are presented. Curve A represents the linear temperature gradient appearing on the fabric, and hence each fiber, during exposure to a single electrifier cylinder. Curve B is a typical temperature gradient achievable with the present invention.

Figure 4A:
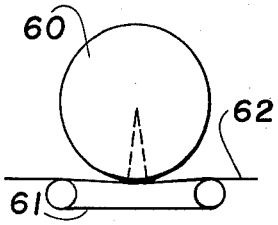
FIG. 4A PRIOR ART
FIGS. 4A and 4B are schematic views of a prior art electrifier cylinder arrangement using an apron conveyor and illustrating different degrees of fabric wrap about the cylinder.
Figure 4B:
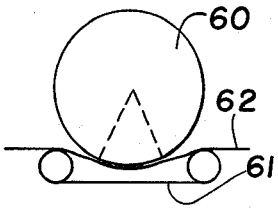
FIG. 4B PRIOR ART

FIGS. 4A and 4B illustrate a prior art electrifier cylinder 60 supplied with an apron conveyor 61. In FIG. 4A, the apron 61 is only slightly wrapped about electrifier cylinder 60 giving rise to relatively small surface contact between the fabric 62 and the cylinder. As the fabric is exposed to the cylinder during its passage, its temperature is elevated. This elevation is substantially linear as shown by Curve A in FIG. 5. In order to increase the temperature, one must increase the degree of wrap as illustrated by FIG. 4B. This increase simply lengthens the processing time. It does not change the slope of curve A. Maximum wrap is limited by the maximum temperature that can be tolerated. If it is desired to increase the processing time, one must reduce the slope of the curve by reducing the cylinder temperature so that the objectionable maximum temperature is not reached. Clearly, it is not possible to select an optimum temperature and maintain that temperature during treatment, when utilizing a single cylinder.

In contrast, Curve B illustrates that with the tandem cylinder treatment of the present invention a flat optimum level is achieved. This is obtained by regulating the temperature of succeeding downstream cylinders to merely sustain the temperature initially reached. The temperature tempering resulting from plural cylinder treatment insures superior finish permanence.

The ability to independently control the speed of each of a plurality of tandem electrifier cylinders also yields hitherto unavailable treatment possibilities. For example, by establishing different speeds for each cylinder, one may modify beat rate and oscillation of the fabric as treatment progresses. If the pair of five grooved cylinders arranged as in FIG. 2 are used, the upstream cylinder 10 might be rotated at 500 revolutions per minute to create a beat rate of 2,500, with relatively slow oscillation of the fabric. This relative slow rate of rotation permits good temperature transfer between the cylinder and the fabric and will produce a left hand pile lay as the fabric emerges from cylinder 10. The downstream cylinder 11 might be rotated at 1200 revolutions per minute to create a beat rate of 6,000. The oscillation of the fabric under these conditions is high and the temperature transfer between cylinder and fabric somewhat less than with the lower speed. The final lay of the fabric will depend upon the relative temperatures and speed of each cylinder.

The inventor's U.S. Pat. No. 3,785,016 teaches the advantages of using a contoured cloth rest in conjunction with electrifier cylinders. The tandem cylinder arrangement of the present invention, enhances still further the advantages of contoured cloth rests since one has greater temperature and speed control available to optimize treatment penetration.

Although only two tandem electrifier cylinders have been shown in connection with the above embodiment, it is recognized that greater numbers yield advantageous results in appropriate circumstances. Furthermore, utilization of the plural cylinder system yields a wide range of variable control which can be either narrowed or broadened by the selection of particular groove configurations on each cylinder. The effects of groove pitch and the direction of cylinder rotation will be optimized for each installation and use.

Modifications of the disclosed system will be apparent to those skilled in the art. All modifications coming within the spirit and teachings of the present invention are intended to be covered by the appended claims.

What is claimed is:

1. In a method of treating synthetic pile fabric to establish any desired lateral lay of the pile, involving transporting said fabric along a predetermined path, subjecting the fibers of said fabric for a controlled period of time to beating, electrification and heating as it passes a first location along said path, and thereafter subjecting the fibers of said fabric for a second controlled period of time to beating, electrification and heating as it passes a second location along said path, said second location being adjacent to said first location; the improvement comprising biasing the lay of said fibers in a first lateral direction only at said first location, and biasing the lay of said fibers in the opposite lateral direction only at said second location, whereby said fibers are swept in a first lateral direction at said first location and swept in the opposite lateral direction at said second location.

2. A method of treating synthetic pile fabric as defined in claim 1, wherein said beating, electrification and heating at each location is effected by a rotating electrifier cylinder.

3. A method of treating synthetic pile fabric as defined in claim 2, including separately controlling the speed of rotation of said electrifier cylinders.

4. A method of treating synthetic pile fabric as defined in claim 2, including separately controlling the temperature of said electrifier cylinders to maintain a substantially predetermined temperature range on the fibers of said fabric as it leaves said first location and passes said second location.

5. A method of treating synthetic pile fabric as defined in claim 4, including separately controlling the speed of rotation of said electrifier cylinders.

6. A method of treating synthetic pile fabric as defined in claim 5, including presenting said fabric to at least one of said electrifier cylinders with uneven spacing between the surface of the fabric and said cylinder, whereby the fibers are exposed differently to said beating, electrification and heating depending upon their proximity to the surface of said cylinder.

7. Apparatus for treating synthetic pile fabric to establish any desired lateral lay of the pile, comprising first and second adjacent electrifier cylinders mounted for rotation about parallel axes, said first cylinder having longitudinal grooves in the surface thereof inclined in a first direction from the axis only and said second cylinder having longitudinal grooves in the surface thereof inclined in the opposite direction from the axis only, means for transporting said fabric along a path substantially orthogonal to said axes and in proximity to said cylinders, and means for rotating said cylinders at various rates of speed, whereby said fibers are swept in a first lateral direction at said first location and swept in the opposite lateral direction at said second location.

8. Apparatus for treating synthetic pile fabric as defined in claim 7, including means for independently varying the temperature of each of said cylinders.

9. Apparatus for treating synthetic pile fabric as defined in claim 7, including contoured cloth rest means for unevenly presenting said fabric to at least one of said cylinders, whereby the fabric is exposed unevenly to the effects of said cylinder.

10. Apparatus for treating synthetic pile fabric as defined in claim 7, including means for controlling the rotational speed of one of said cylinders relative to the other, and means for controlling the relative temperature of said cylinders to effect a linear increase in fabric temperature by the upstream cylinder, and maintenance of a relatively constant fabric temperature by the succeeding cylinder.

* * * * *